United States Patent [19]

Omachi et al.

[11] 4,034,729

[45] July 12, 1977

[54] PREHEATING APPARATUS OF A DIESEL ENGINE

[75] Inventors: Yoshio Omachi; Ichiro Hasegawa; Hiroshi Watanabe, all of Hiratsuka, Japan

[73] Assignee: Kabushiki Kaisha Komatsu Seisakusho, Tokyo, Japan

[21] Appl. No.: 675,464

[22] Filed: Apr. 9, 1976

Related U.S. Application Data

[63] Continuation-in-part of Ser. No. 498,095, Aug. 16, 1974, abandoned.

[51] Int. Cl.[2] ..... F02M 31/00

[52] U.S. Cl. ..... 123/122 G; 123/122 D; 123/179 H

[58] Field of Search ..... 123/122 G, 122 D, 179 H, 123/122 H; 432/222

[56] References Cited

U.S. PATENT DOCUMENTS

| | | | |
|---|---|---|---|
| 3,731,666 | 5/1973 | Langen | 123/179 H |
| 3,960,121 | 6/1976 | Backus | 123/122 G |
| 3,977,376 | 8/1976 | Reid | 123/122 G |

*Primary Examiner*—Ronald H. Lazarus
*Attorney, Agent, or Firm*—Spensley, Horn and Lubitz

[57] ABSTRACT

In a preheating apparatus of a diesel engine of the type wherein, at the time of starting the engine, a fuel pump is used to inject fuel through a nozzle into a precombustion chamber provided with a preheating device, and the suction air preheated by the combustion of the fuel injected into the precombustion chamber is supplied into the combustion chamber of the engine, until the speed reaches a certain predetermined value and with a substantially constant, small amount of fuel when the speed of the engine is in excess of the predetermined value, the opening of the nozzle is controlled in accordance with the speed of the engine.

1 Claim, 5 Drawing Figures

PREHEATING APPARATUS OF A DIESEL ENGINE

BACKGROUND OF THE INVENTION

This is a continuation-in-part application of U.S. patent application Ser. No. 498,095 now abandoned filed Aug. 16, 1974.

This invention relates to a preheating apparatus of a diesel engine.

To satisfactorily start a diesel engine in cold season, it is necessary to preheat suction air before it is fed to the combustion chamber of the engine for improving the efficiency of combustion and for facilitating the starting.

As shown in FIG. 1, according to a conventional preheating device, an electric heater 4 is provided in an air suction pipe of the engine and as the temperature of the heater 4 reaches a predetermined value a fuel nozzle 3 is opened to inject a predetermined quantity of the fuel under static head or by a fuel pump for burning the fuel by the heat generated by the heater 4 thus preheating the suction air. However, in such prior art preheating apparatus, since the fuel is injected and burnt irrespective of the rotation of the engine, the combustion of the fuel sometimes is interrupted due to deficiency of oxygen or air blow with the result that the ignition of the engine is delayed.

SUMMARY OF THE INVENTION

Accordingly, it is an object of this invention to provide an improved preheating apparatus of a diesel engine capable of eliminating the difficulty described above.

Another object of this invention is to provide an improved preheating apparatus of a diesel engine capable of preheating the suction air with fuel of a quantity proportional to the speed of the engine.

According to this invention there is provided a preheating apparatus of a diesel engine of the type wherein, at the time of starting the engine, a fuel pump is used to inject fuel through a nozzle into an air suction pipe, and the suction air preheated by the combustion of the fuel injected into the air suction pipe is supplied into the combustion chamber of the engine, characterized in that the opening of the nozzle is controlled in accordance with the speed of the engine.

DESCRIPTION OF THE PREFERRED EMBODIMENT

Figure 1:
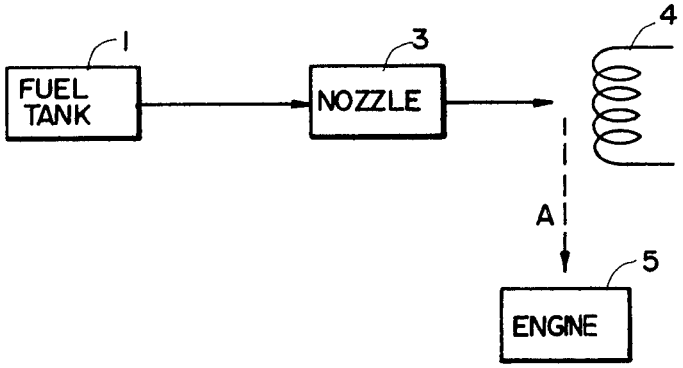
FIG. 1 is a block diagram showing one example of a prior art preheating apparatus of a diesel engine.
Figure 2:
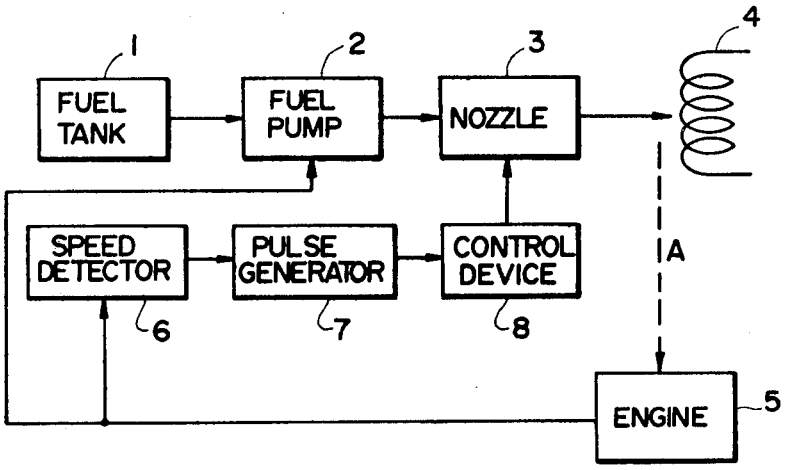
FIG. 2 is a block diagram showing one embodiment of the preheating apparatus embodying the invention.

A preferred embodiment of this invention illustrated in FIG. 2 comprises a fuel tank 1, a fuel pump 2, a nozzle 3 and an electric heater 4 mounted in an air suction pipe. The fuel pump 2 is driven at a constant speed by a diesel engine 5 or may be driven by a battery. Instead of the fuel pump 2, a fuel pump for feeding fuel to the engine may be utilized for this purpose. The opening of the nozzle 3 is controlled by a fuel control circuit including a speed detector 6 for detecting the number of revolutions of the engine 5, a pulse generator 7 for generating a pulse of which the pulse width decreases and duty increases until the revolution number reaches a predetermined value and the pulse width and duty become small when the revolution number exceeds the predetermined value, and a control device 8 responsive to the pulse for controlling the opening and closing of the nozzle 3.

The operation of the novel preheating apparatus is as follows:

At start, the engine 5 is started by a starter, not shown, and the fuel is supplied to the nozzle 3 under a constant pressure. At the same time, the speed of the engine is detected by the speed detector 6 and the control device 8 is actuated by the pulse which is generated by the pulse generator 7 and in a predetermined relation thereby injecting the fuel of the necessary quantity through the nozzle 3. The injected fuel is burnt by the heat generated by the preheating heater 4 so that air A preheated by the combustion of the injected fuel is supplied to the combustion chamber of the engine 5.

Figure 3:
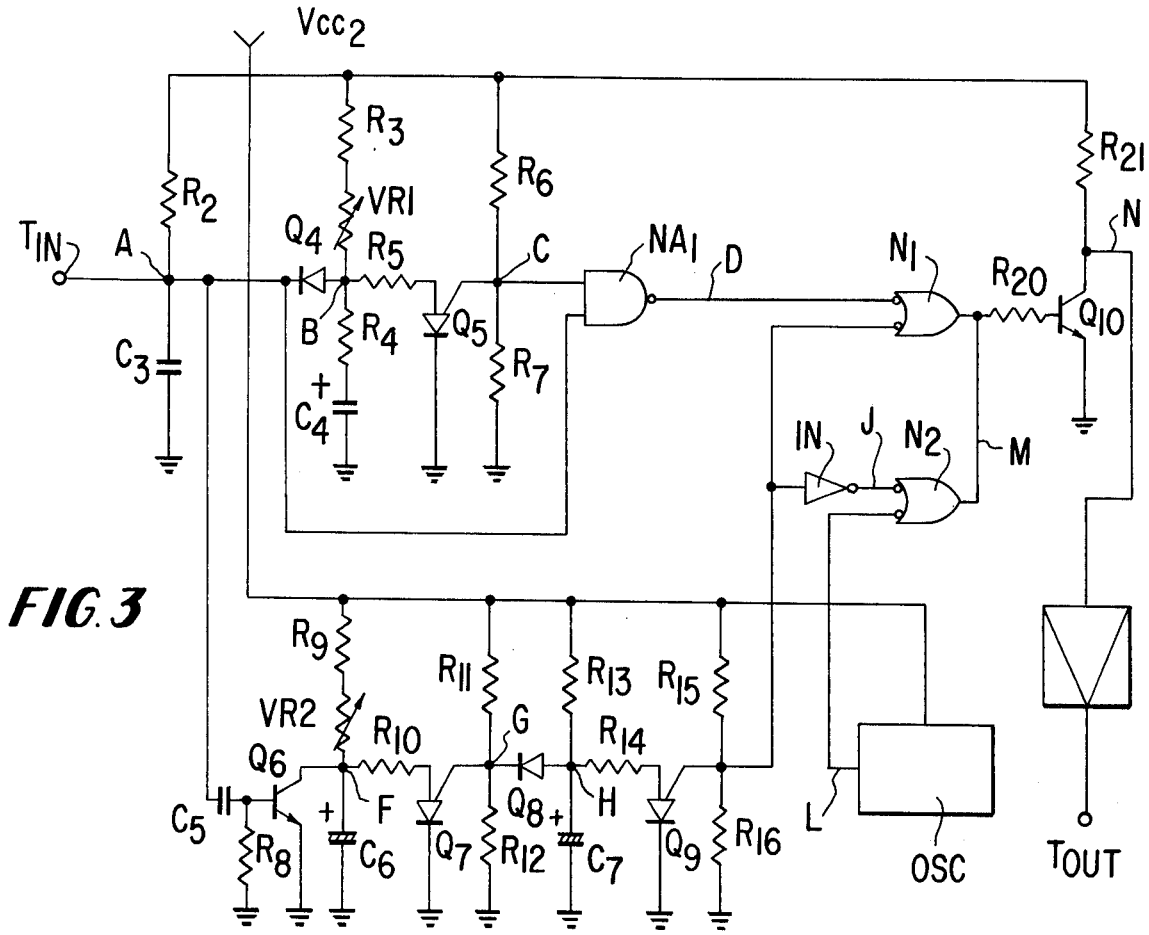
FIG. 3 is a circuit diagram showing the pulse generator 7 of FIG. 2 in detail.
Figure 4:
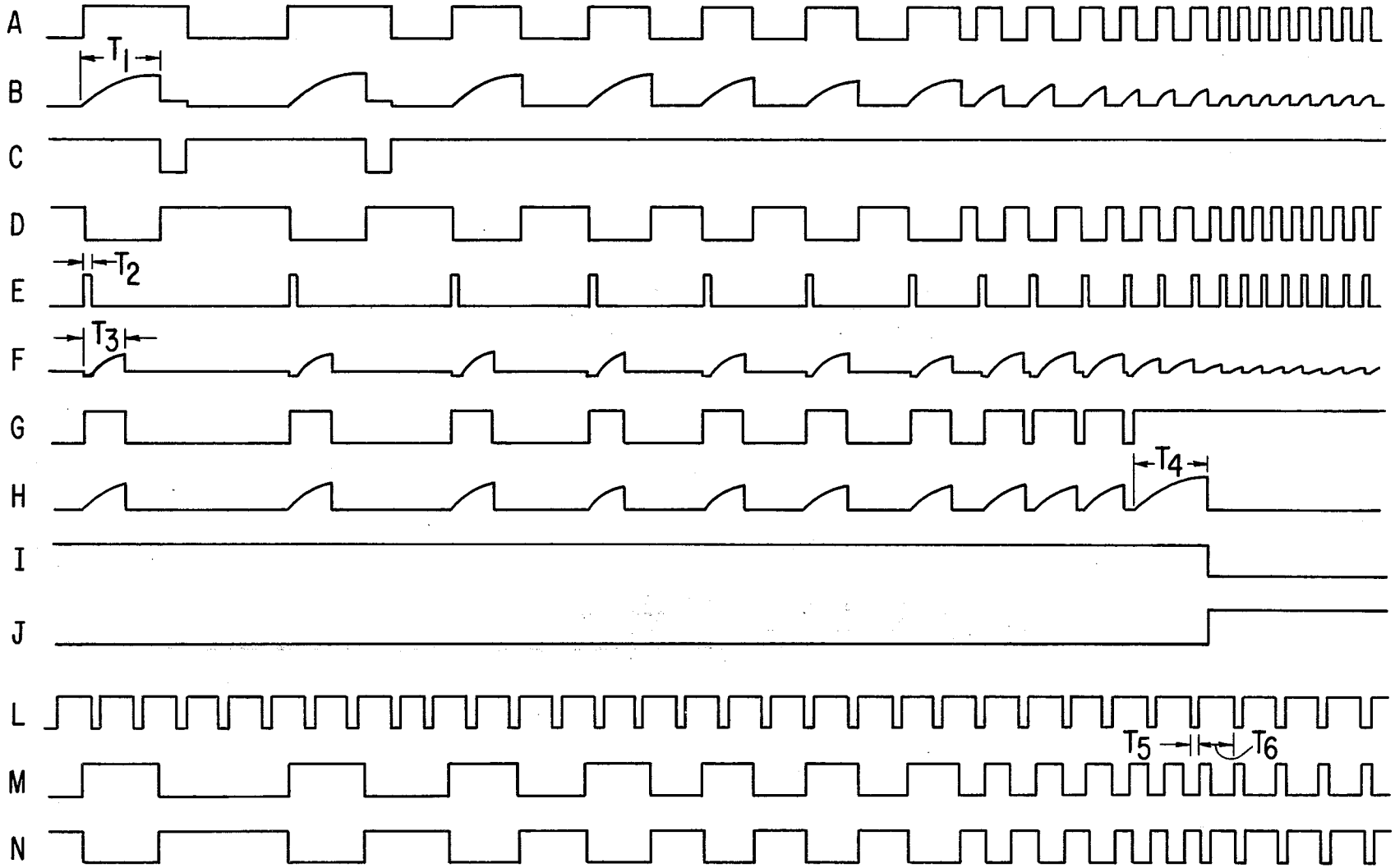
FIG. 4 is a graphical diagram showing waveforms of pulses appearing in the respective portions of the circuit shown in FIG. 3.

FIG. 3 is a circuit diagram showing the pulse generator 7 of FIG. 2 in detail. A speed pulse shown as A in FIG. 4 is applied from a speed detector 6 to an input terminal $T_{IN}$. FIG. 4 (A) shows a typical speed pulse appearing when the speed gradually increases from 0 to a predetermined revolution number, e.g. 500 rpm and increases further. Accordingly, a diode $Q_4$ is OFF only while the pulse is being applied to the terminal $T_{IN}$. During this time a capacitor $C_4$ is charged through resistor $R_3$, variable resistor $VR_1$ and resistor $R_4$. While the pulse A shown in FIG. 4 is being applied, charged voltage in the capacitor $C_4$ (FIG. 4(B)) reaches a certain level when charging time $T_1$ has elapsed. A programmable unijunction transistor $Q_5$ thereupon is turned ON causing the charged voltage in the capacitor $C_4$ to be discharged through the transistor $Q_5$. Unless the charged voltage in the capacitor $C_4$ has reached a certain level while the pulse shown in FIG. 4 (A) is at a high level, the transistor $Q_5$ is not in conduction. When the pulse A falls to a low level, th charged voltage in the capacitor $C_4$ is discharged through the diode $Q_4$. Accordingly, voltage at the gate of the transistor $Q_5$ is low only when the transistor $Q_5$ is ON as shown in FIG. 4 (C) and otherwise always high. Since NAND circuit NA, produces logical products of the signals A and C and inverts the same, the output of the NAND circuit $NA_1$ takes a form as shown in FIG. 4 (D).

The pulse signal applied to the terminal $T_{IN}$ is differentiated by a differentiation circuit consisting of a resistor $R_8$ and a capacitor $C_5$ and a pulse as shown in FIG. 4 (E), having typically a pulse width $T_2$ = 2msec, is produced. A transistor $Q_6$ is ON only when the pulse E is being applied thereto. While the transistor $Q_6$ is OFF, a capacitor $C_6$ continues to be charged. When the charged voltage has reached a certain level, the transistor $Q_7$ is brought into conduction. The ON state of the transistor $Q_7$ continues until a next pulse E arrives. The gate voltage of the transistor $Q_7$ takes a waveform as shown in FIG. 4 (G). In a case wherein the interval of the pulse E becomes short due to increase of the speed and a next pulse E arrives before the charged voltage reaches the predetermined level, the transistor $Q_7$ does not become conductive and the gate voltage G of the transistor $Q_7$ remains at a high level.

Diode $Q_8$ is OFF while the pulse G remains at a high level and, accordingly, the capacitor $C_7$ is charged. Since the pulse width of the pulse G is relatively small until the speed reaches a certain revolution number, e.g. 500 rpm, it is not sufficient to bring a unijunction transistor $Q_9$ into conduction. When the speed has reached 500 rpm, charging time of the capacitor $C_7$ becomes long as designated by reference characters $T_4$ and this brings the transistor $Q_9$ into conduction. Accordingly, the gate voltage of the transistor $Q_9$ remains at a high level until the speed reaches 500 rpm and drops to a low level as the speed exceeds 500 rpm.

Signal J in FIG. 4 is obtained by inverting a signal I in FIG. 4 by an inverter IN. An oscillator OSC generates a pulse of a constant period (FIG. 4 (L)) (e.g. $T_5$ is 10 msec and $T_6$ is 40 msec).

The output signal D of the NAND circuit $NA_1$ and the signal I are applied to a NOR circuit $N_1$ whereas the signals J and L are applied to a NOR circuit $N_2$. The outputs of the NOR circuits $N_1$, $N_2$ are combined together. The combined signal takes a waveform a shown in FIG. 4 (M). The signal M is applied to a transistor $Q_{10}$ and, accordingly, an inverted signal as shown in FIG. 4 (N) is produced from the collector of the transistor $Q_{10}$.

The signal N thereafter is amplified in an amplifier AM and provided from an output terminal $T_{OUT}$. This output signal is applied to a control device 8 shown in FIG. 2. The control device 8 controls the nozzle 3 so as to open it only when the signal from terminal $T_{OUT}$ is a low level signal.

Figure 5:
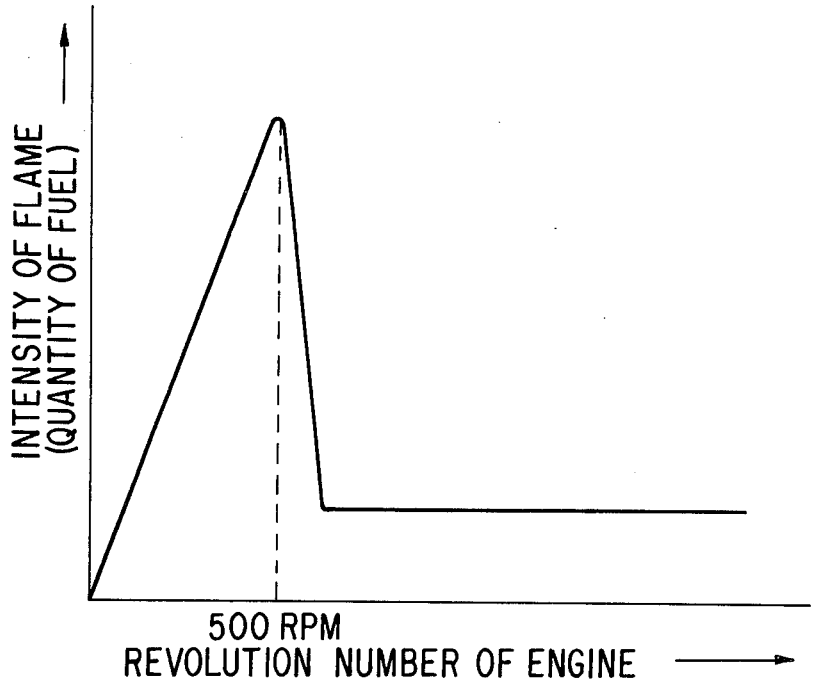
FIG. 5 is a graphical diagram showing relationship between the revolution number of the engine and intensity of the flame, i.e. quantity of the fuel.

As will be apparent from the waveform of the signal N shown in FIG. 4, the time during which the signal N is at a low level gradually increases proportionally to the increase of the revolution number of the engine until the revolution number reaches a certain value, e.g. 500 rpm. When the revolution number has exceeded 500 rpm, the pulse width of the low level abruptly becomes narrow and the pulse interval of the low level becomes long. This signifies that, as shown in FIG. 5, the intensity of flame increases in proportion to the revolution number until the revolution number reaches 500 rpm and, accordingly, starting of the engine can be effectively controlled. Whereas, when the revolution number has exceeded 500 rpm, the engine can be run stably by only slightly warming the suction air.

In practice, the speed detector 6 may by any means or apparatus for sensing the speed of the engine which generates a series of pulses corresponding to the engine speed. Furthermore, nozzle 3 can be anyone of several devices available in the art.

As described hereinabove, the preheating apparatus of a diesel engine embodying the invention injects an adequate quantity of the fuel commensurate with the speed of the engine into an air suction pipe for burning the injected fuel therein. Accordingly, the inventive apparatus is capable of eliminating such troubles as incomplete combustion due to shortage of oxygen or extinguishment of the flame due to air blow and sending preheated air into the combustion chamber of the engine. As a result, the variation in the combustion condition in the air suction pipe does not affect the operation of the engine and a smooth and accurate starting of the engine is ensured even in a cold season.

It should be understood that the invention is not limited to the specific embodiment shown and described.

We claim:

1. In preheating apparatus of a diesel engine of the type wherein, at the time of starting the engine, a fuel pump injects fuel through a nozzle into an air suction pipe of the engine, and the suction air preheated by the combustion of the fuel injected into the precombustion chamber is supplied into the combustion chamber of the engine, the improvement which comprises:

a speed detector producing a pulse whose high level periods per unit time increases in proportion to the speed of the engine:

A pulse generator receiving the pulse provided by said speed detector and producing the same type of pulses as the input pulses thereof until the revolution number of the engine reaches a predetermined value and pulses with a relatively narrow pulse width and a long interval when the revolution number has exceeded the predetermined value; and a nozzle control device receiving the pulse from said pulse generator and causing said nozzle to open only during application of said pulses from said pulse generator.

* * * * *